US010612301B2

(12) United States Patent
Derk, Jr. et al.

(10) Patent No.: US 10,612,301 B2
(45) Date of Patent: Apr. 7, 2020

(54) SYSTEM AND METHOD FOR LEVELING A MOTORIZED WINDOW TREATMENT

(71) Applicant: Crestron Electronics, Inc., Rockleigh, NJ (US)

(72) Inventors: Charles R. Derk, Jr., Park Ridge, NJ (US); Luis J. Rivera, Dumont, NJ (US); Michael Campagna, Woodcliff Lake, NJ (US); Benjamin Slivka, Hillsdale, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 172 days.

(21) Appl. No.: 15/657,885

(22) Filed: Jul. 24, 2017

(65) Prior Publication Data

US 2019/0024452 A1 Jan. 24, 2019

(51) Int. Cl.
*E06B 9/72* (2006.01)
*E06B 9/42* (2006.01)
(Continued)

(52) U.S. Cl.
CPC ..... *E06B 9/72* (2013.01); *E06B 9/42* (2013.01); *E06B 9/88* (2013.01); *A47H 1/13* (2013.01); *E06B 9/50* (2013.01); *E06B 2009/6809* (2013.01); *E06B 2009/6818* (2013.01); *E06B 2009/6845* (2013.01)

(58) Field of Classification Search
CPC ..... E06B 9/68; E06B 2009/6809; E06B 2009/6818; E06B 2009/6845; E06B 9/80; E06B 9/82; E06B 9/88; E06B 2009/885; E06B 9/72; E06B 9/42; E06B 9/50; A47H 1/13
See application file for complete search history.

(56) References Cited

U.S. PATENT DOCUMENTS 6,196,508 B1 * 3/2001 Nijs ..... A47H 1/13 248/267
6,260,908 B1 * 7/2001 Fraula ..... E04F 10/0603 135/88.12

(Continued)

OTHER PUBLICATIONS

DimensionEngineering, A Beginner's Guide to Accelerometers, available at www.dimensionengineering.com/info/accelerometers, accessed on Jun. 2, 2017.

(Continued)

*Primary Examiner* — Daniel P Cahn
(74) *Attorney, Agent, or Firm* — Crestron Electronics, Inc.

(57) ABSTRACT

A motorized window treatment configure for automatically determining and reporting the tilt level of a motorized window treatment. The motorized window treatment comprises a window covering material, a motor configured for moving the window covering material from an opened position to a closed position, an accelerometer configured for measuring gravitational forces, and a controller configured for reporting the tilt level of the motorized window treatment. Particularly, the controller receives gravitational force measurements from the accelerometer, determines a tilt level of the motorized window treatment using the gravitational force measurements, compares the tilt level to a first threshold value, and issues an error signal when the tilt level exceeds the first threshold value.

27 Claims, 8 Drawing Sheets

(51) Int. Cl.

| | |
|---|---|
| ***A47H 1/13*** | (2006.01) |
| ***E06B 9/88*** | (2006.01) |
| *E06B 9/68* | (2006.01) |
| *E06B 9/50* | (2006.01) |

(56) References Cited

U.S. PATENT DOCUMENTS

| | | | | |
|---|---|---|---|---|
| 7,729,807 | B2 * | 6/2010 | Guillemot | E04F 10/0659 160/7 |
| 7,740,047 | B2 * | 6/2010 | Koop | E06B 9/50 160/323.1 |
| 7,854,419 | B2 * | 12/2010 | Ng | E06B 9/50 160/323.1 |
| 8,122,932 | B2 * | 2/2012 | Cannaverde | E06B 9/174 160/120 |
| 8,967,568 | B2 * | 3/2015 | Wills | E06B 9/50 248/269 |
| 9,347,261 | B2 * | 5/2016 | Blair | E06B 9/68 |
| 2004/0031321 | A1 * | 2/2004 | Orsat | E04F 10/0659 73/170.01 |
| 2008/0163685 | A1 * | 7/2008 | Lapierre | E04F 10/0659 73/514.05 |
| 2011/0048651 | A1 * | 3/2011 | Goth | E04F 10/0614 160/22 |
| 2014/0090787 | A1 * | 4/2014 | Colson | E06B 9/82 160/7 |
| 2014/0290870 | A1 * | 10/2014 | Colson | F16H 59/0278 160/10 |
| 2015/0028054 | A1 * | 1/2015 | Norman | A47K 5/1217 222/52 |
| 2015/0107788 | A1 * | 4/2015 | Mullet | A47H 1/02 160/405 |
| 2016/0017656 | A1 * | 1/2016 | Adreon | E06B 9/322 160/7 |
| 2017/0275884 | A1 * | 9/2017 | Thompson | E04F 10/0633 |
| 2017/0324908 | A1 * | 11/2017 | Gharabegian | H04N 5/247 |
| 2018/0187447 | A1 * | 7/2018 | Gharabegian | F21V 33/0004 |
| 2018/0325333 | A1 * | 11/2018 | Murphy | A47K 10/16 |
| 2018/0368628 | A1 * | 12/2018 | Schuh | A47K 10/3687 |
| 2019/0071877 | A1 * | 3/2019 | Prohaszka | E04F 10/06 |
| 2019/0301166 | A1 * | 10/2019 | Thompson | E04F 10/0688 |

OTHER PUBLICATIONS

Freescale Semiconductor, Tilt Sensing Using a Three-Axis Accelerometer, Document No. AN3461, Rev. 6, Mar. 2013, available at cache.freescale.com/files/sensors/doc/app_note/AN3461.pdf.

STMicroelectronics, Tilt Measurement Using a Low-g 3-axis Accelerometer, DocID026445 Rev 1, Jun. 2014, available at www.st.com/content/ccc/resource/technical/document/application_note/d2/d6/22/4f/b9/8f/45/59/DM00119046.pdf/files/DM00119046.pdf/jcr:content/translations/en.DM00119046.pdf.

Fisher, Digi-Key Electronics, Using an Accelerometer for Inclination Sensing, May 6, 2011, available at www.digikey.com/en/articles/techzone/2011/may/using-an-accelerometer-for-inclination-sensing.

* cited by examiner

SYSTEM AND METHOD FOR LEVELING A MOTORIZED WINDOW TREATMENT

BACKGROUND OF THE INVENTION

Technical Field

Aspects of the embodiments relate to motorized window treatments, and more particularly to systems, methods, and modes for automatically determining and reporting the tilt level of a motorized window treatment.

Background Art

Motorized window treatments provide a convenient one-touch control solution for screening windows, doors, or the like, to achieve privacy and thermal effects. Various types of motorized window treatments exist, including motorized roller shades, inverted rollers, Roman shades, Austrian shades, pleated shades, blinds, shutters, skylight shades, garage doors, or the like. A typical motorized window treatment includes a shade material that is manipulated by the motor to cover or uncover the window.

For proper operation, a motorized window treatment, such as a roller shade, must be installed on a level surface. When the roller shade is properly leveled, it will continuously run up and down square to the roller tube. In production, a roller shade is constructed on a substantially perfectly leveled gantry. The expectation is when the roller shade goes out to the field, it will maintain that level. Yet, motorized window treatments are commonly misaligned during installation. This causes the motorized treatment to operate improperly. For example, in a roller shade, the rotational axis of the roller tube is not parallel with the floor. When the roller tube is oriented even slightly off the horizontal rotational axis, impermissible stresses are introduced on the roller tube and/or on the gears of an attached shade motor when the shade motor rotates the roller tube. Further, the shade material does not wind or unwind evenly. If the shade is not level, the shade material will telescope left or right, causing the shade material to rub against the window frame. This leads to a crooked, wrinkled, and/or damaged shade.

Adjustable mounting brackets exist that allow the motorized window treatment to be leveled during installation. However, there is no readily available indication of the shade being leveled. Thus, installers often do not check and adjust the level of the motorized window treatment prior to operation until a problem occurs.

Accordingly, a need has arisen for a motorized window treatment that can automatically determine and report its tilt level.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a motorized window treatment that will obviate or minimize problems of the type previously described.

More particularly, it is an aspect of the embodiments to provide systems, methods, and modes for automatically determining and reporting the tilt level of a motorized window treatment.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to an aspect of the embodiments a motorized window treatment assembly is provided. The motorized window treatment assembly comprises a window covering material, a motor configured for moving the window covering material from an opened position to a closed position, an accelerometer configured for measuring gravitational forces, and a controller. The controller is configured for reporting a tilt level of the motorized window treatment by receiving gravitational force measurements from the accelerometer; determining a tilt level of the motorized window treatment using the gravitational force measurements; comparing the tilt level to a first threshold value; and issuing an error signal when the tilt level exceeds the first threshold value.

According to an embodiment, the accelerometer may comprise a three-axis accelerometer. The tilt level may comprise a tilt angle of the motorized window treatment. The controller of the motorized window treatment assembly may be further configured for: comparing the tilt level to a second threshold value, and issuing a second error signal upon determining that tilt level exceeds the second threshold value.

According to an embodiment, the error signal may comprises a light indicator. According to another embodiment, the error signal may comprise an audible indicator. The audible indicator may be emitted via at least one of a speaker and the motor. The motorized window treatment may further comprise an interface, the error signal may comprise an error message, and the controller may be configured for transmitting the error message through the interface. The error message may comprise an electronic mail, a text message, a smart message, a short range communication message, or the like. The error message may comprise at least one of a tilt angle and instructions on how to properly level the motorized window treatment. The error signal may further comprise storing the tilt level in a memory of the motorized window treatment. The error signal may also comprise disabling the motor.

According to an embodiment, the error signal may comprise blinking a light indicator and the controller may be further configured for changing a blinking parameter of the light indicator as the tilt level gets closer or farther from the first threshold value. The blinking parameter may comprise a frequency, a duty cycle, a combination thereof, or the like. According to an embodiment, the controller may be further configured for: causing the light indicator to blink faster when the tilt level gets closer to the first threshold value; causing the light indicator to blink slower when the tilt level gets farther from the first threshold value; and causing the light indicator to light solid when the tilt level is below the first threshold value. According to yet another embodiment, the controller may be further configured for storing a relationship between a tilt level and a blinking parameter; determining a blinking parameter of the light indicator by comparing the determined tilt level to the stored relationship; and blinking the light indicator at the determined blinking parameter. The stored relationship may comprise a tilting curve, a lookup table, or the like. According to another embodiment, the controller may be further configured for: determining a tilt direction of the motorized window treatment; causing the light indicator to light solid in a first color when the tilt level is below the first threshold value; causing the light indicator to blink in a second color when the tilt level is above the first threshold value in a first tilting direction; and causing the light indicator to blink in a third color when the tilt level is above the first threshold value in a second tilting direction.

According to another embodiment, the error signal may comprise beeping an audible indicator and the controller may be further configured for: causing the audible indicator to beep faster when the tilt level gets closer to the first threshold value; causing the audible indicator to beep slower when the tilt level gets farther from the first threshold value; and causing the audible indicator to emit a solid tone when the tilt level is below the first threshold value. The controller may be further configured for: determining a tilt direction of the motorized window treatment; causing the audible indicator to emit a first tone when the tilt level is below the first threshold value; causing the audible indicator to emit a second tone when the tilt level is above the first threshold value in a first tilting direction; and causing the audible indicator to emit a third tone when the tilt level is above the first threshold value in a second tilting direction.

According to an embodiment, the motorized window treatment assembly may further comprise a mounting bracket and a handheld leveling tool. The mounting bracket may be configured for attaching the motorized window treatment to a surface and comprising a vertical adjustment screw configured for adjusting a tilt level of the motorized window treatment. The handheld leveling tool may comprise an interface configured for receiving the error signal from the controller, a shank with a tip configured for mating with the vertical adjustment screw, and a second motor configured for rotating the shank. The controller may cause the second motor of the handheld leveling tool to rotate the vertical adjustment screw in a first direction until the tilt level of the motorized window treatment falls below the first threshold value.

According to another embodiment, the motorized window treatment assembly may further comprise a self-adjusting mounting bracket configured for attaching the motorized window treatment to a surface and comprising a second motor configured for adjusting a tilt level of the motorized window treatment and an interface configured for receiving the error signal. The controller may cause the second motor of the self-adjusting mounting bracket to operate in a first direction until the tilt level of the motorized window treatment falls below the first threshold value.

According to another aspect of the embodiments, a motorized window treatment assembly is provided comprising: a window covering material; a motor configured for moving the window covering material from an opened position to a closed position; an accelerometer configured for measuring gravitational forces; a light indicator; and a controller. The controller is configured for reporting a tilt level of the motorized window treatment by: receiving gravitational force measurements from the accelerometer; determining a tilt level of the motorized window treatment using the gravitational force measurements; comparing the tilt level to a first threshold value; blinking the light indicator when the tilt level exceeds the first threshold value; causing the light indicator to blink faster when the tilt level gets closer to the first threshold value; causing the light indicator to blink slower when the tilt level gets farther from the first threshold value; and causing the light indicator to light solid when the tilt level is below the first threshold value.

According to a further aspect of the embodiments, a motorized window treatment assembly is provided comprising: a window covering material; a motor configured for moving the window covering material from an opened position to a closed position; an accelerometer configured for measuring gravitational forces; a light indicator; and a controller. The controller is configured for reporting a tilt level of the motorized window treatment by: receiving gravitational force measurements from the accelerometer; determining a tilt level and a tilt direction of the motorized window treatment using the gravitational force measurements; comparing the tilt level to a first threshold value; storing a relationship between a tilt level and a blinking parameter; determining a blinking parameter of a light indicator by comparing the determined tilt level to the stored relationship; causing the light indicator to light solid in a first color when the tilt level is below the first threshold value; causing the light indicator to blink in a second color at the determined blinking parameter when the tilt level exceeds the first threshold value in a first direction; and causing the light indicator to blink in a third color at the determined blinking parameter when the tilt level exceeds the first threshold value in a second direction.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1:
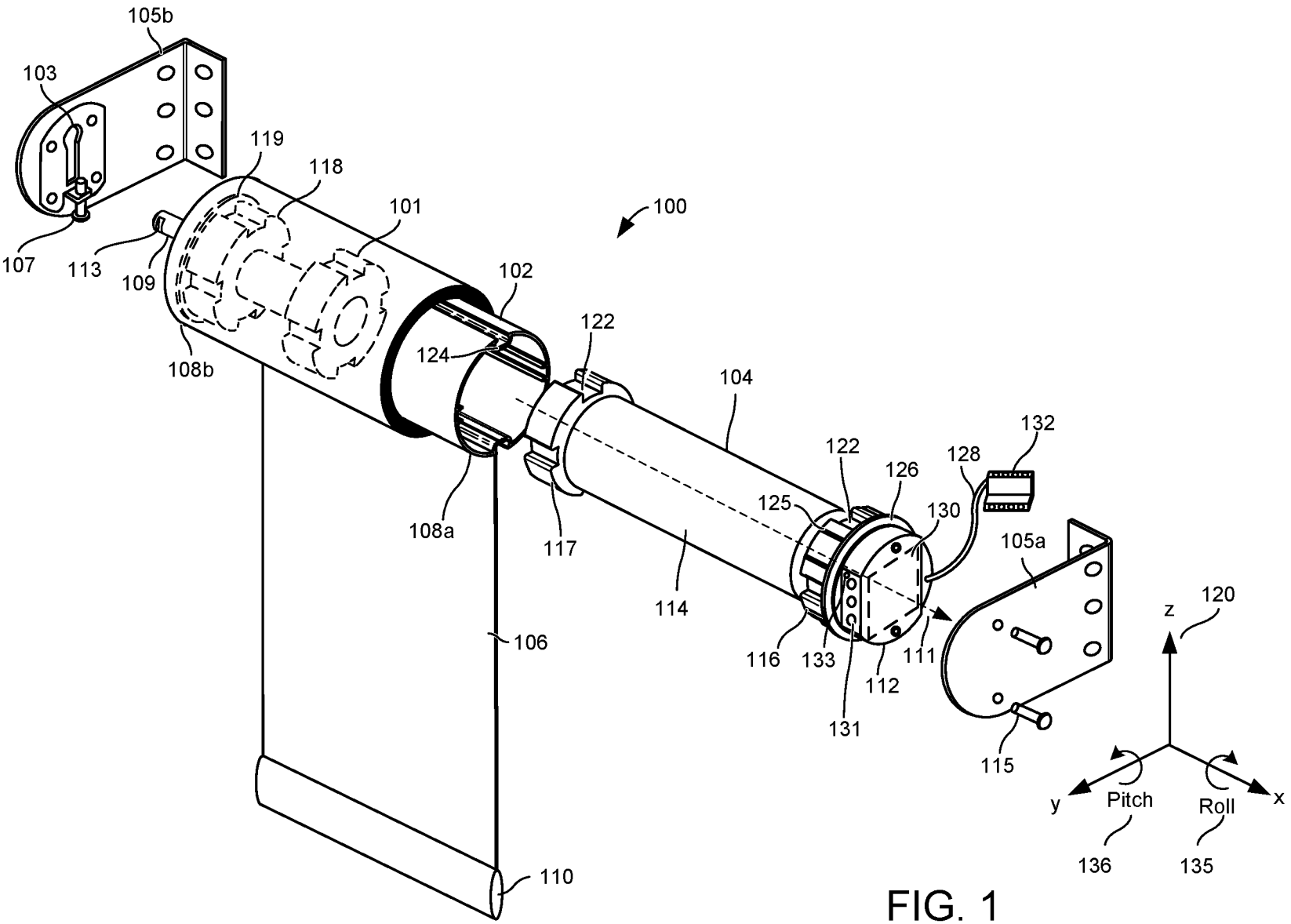

FIG. 1 illustrates an exploded front perspective view of a roller shade according to an illustrative embodiment.

Figure 2:
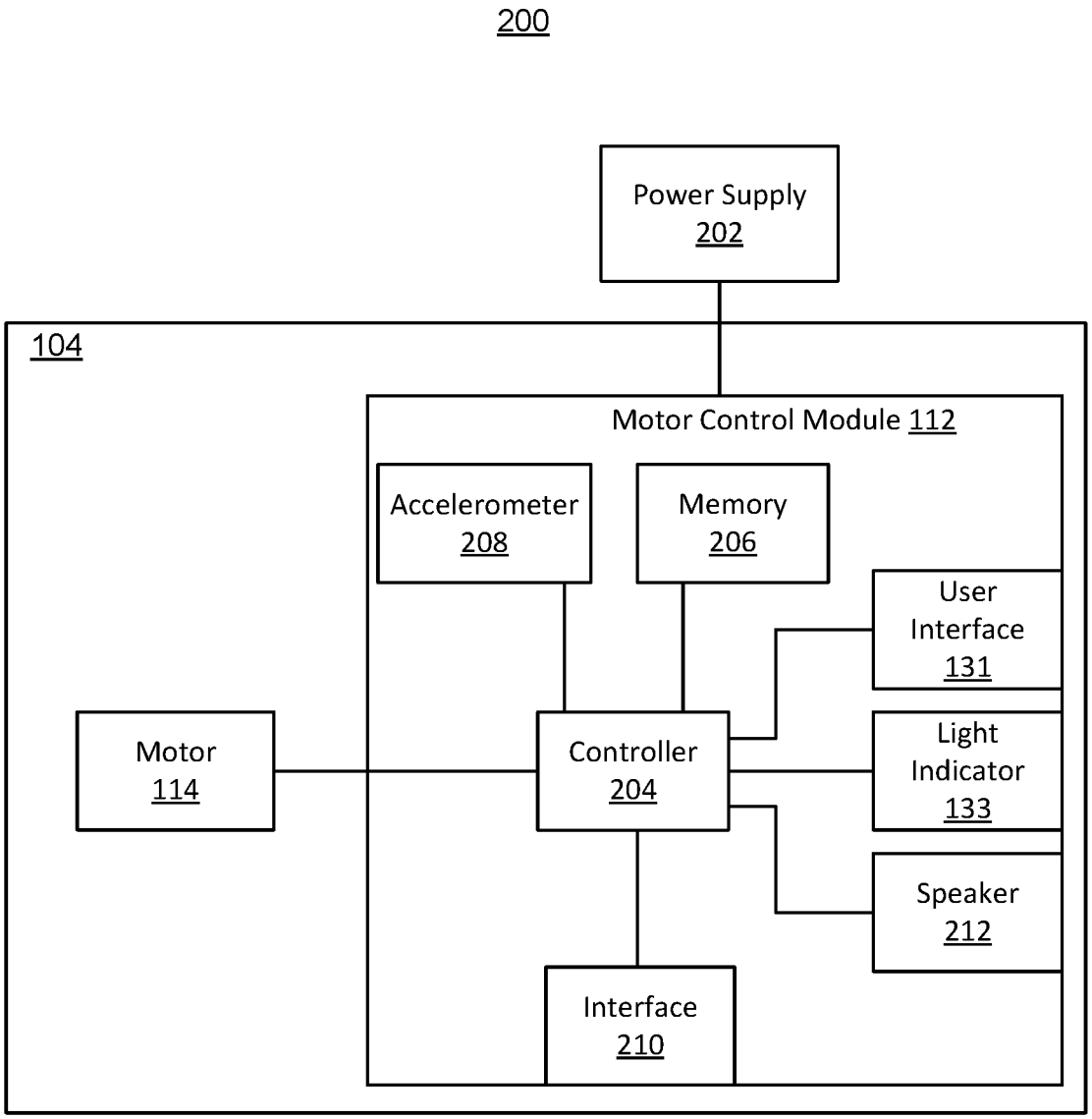

FIG. 2 illustrates a block diagram of a roller shade drive unit of the roller shade according to an illustrative embodiment.

Figure 3A:
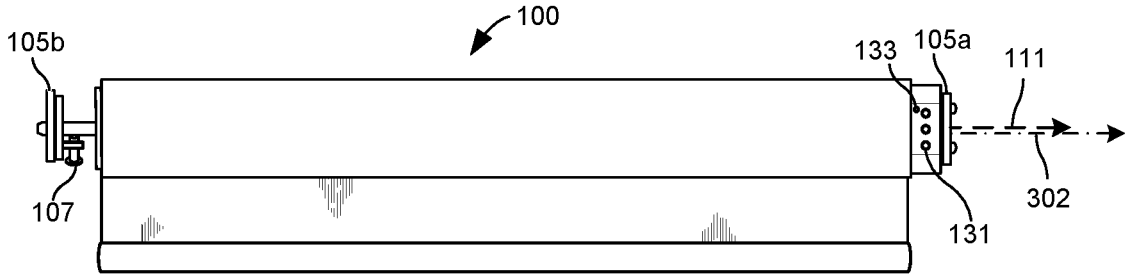

FIG. 3A illustrates a front view of a properly leveled roller shade according to an illustrative embodiment.

Figure 3B:
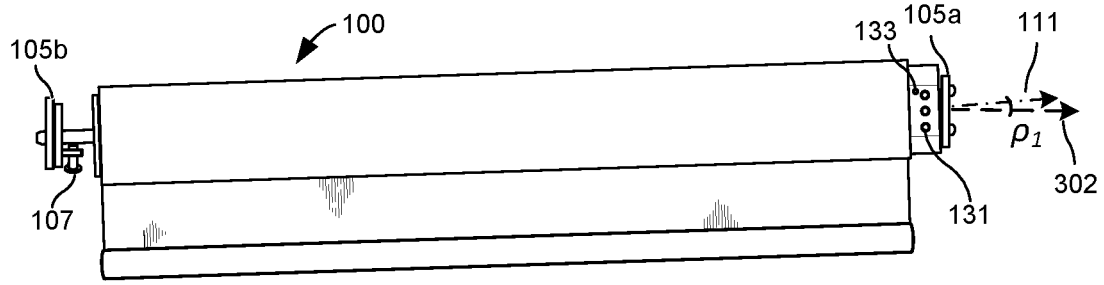

FIG. 3B illustrates a front view of a tilted roller shade with a positive tilt angle according to an illustrative embodiment.

Figure 3C:
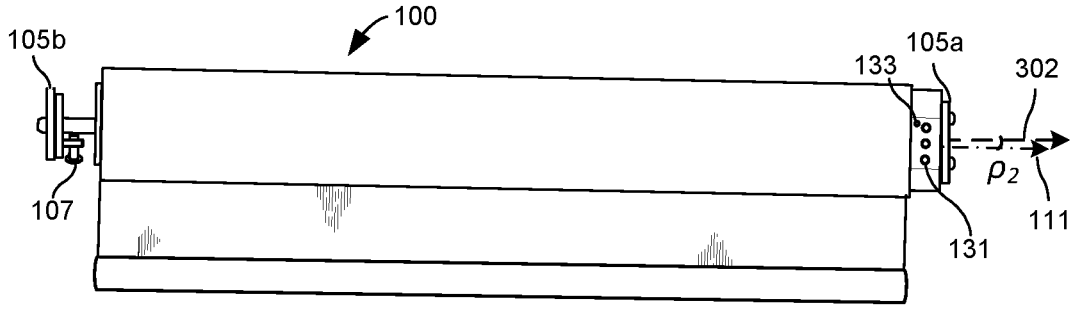

FIG. 3C illustrates a front view of a tilted roller shade with a negative tilt angle according to an illustrative embodiment.

Figure 4:
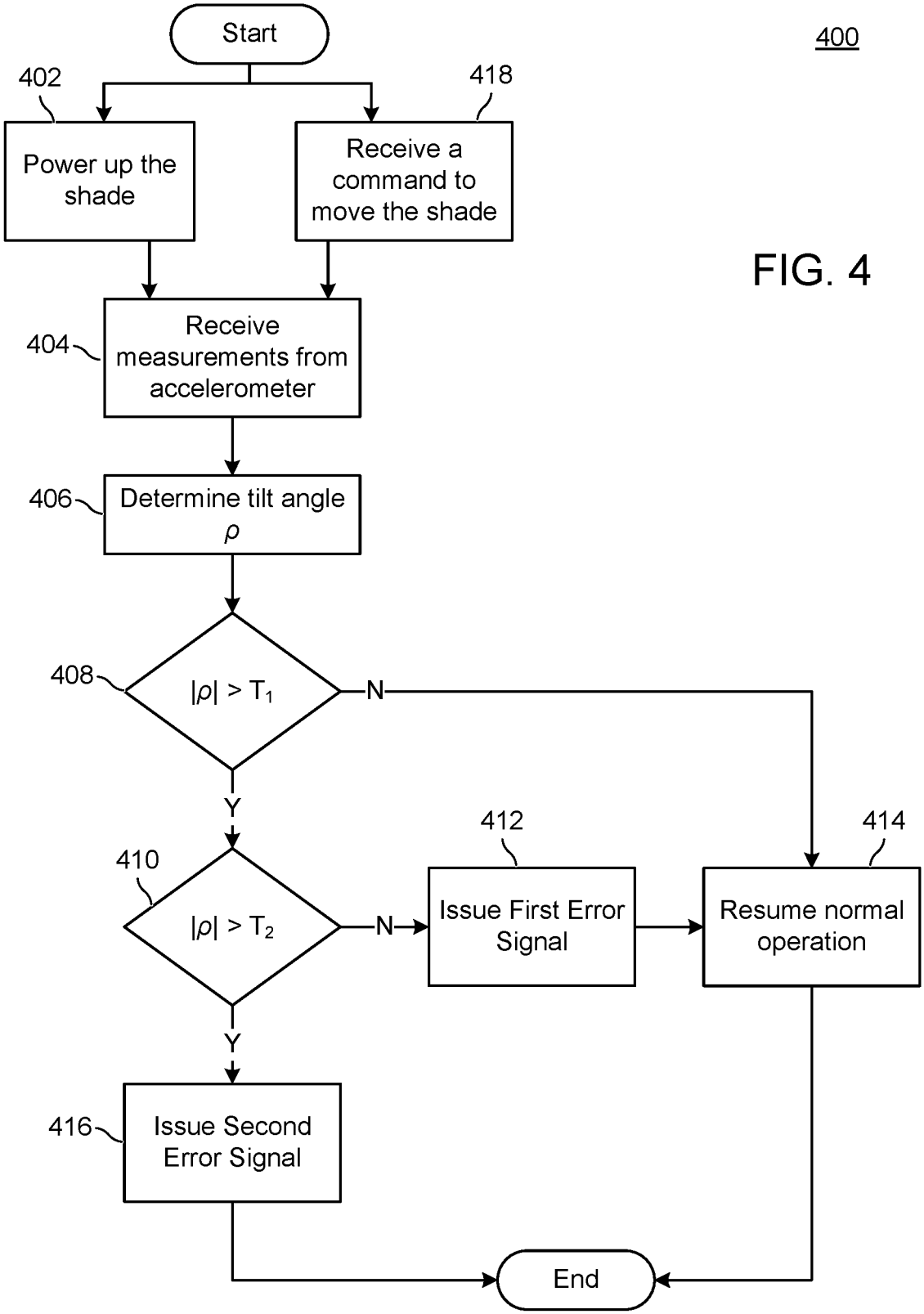

FIG. 4 shows a flowchart illustrating a method of determining whether the roller shade is properly leveled according to an illustrative embodiment.

Figure 5:
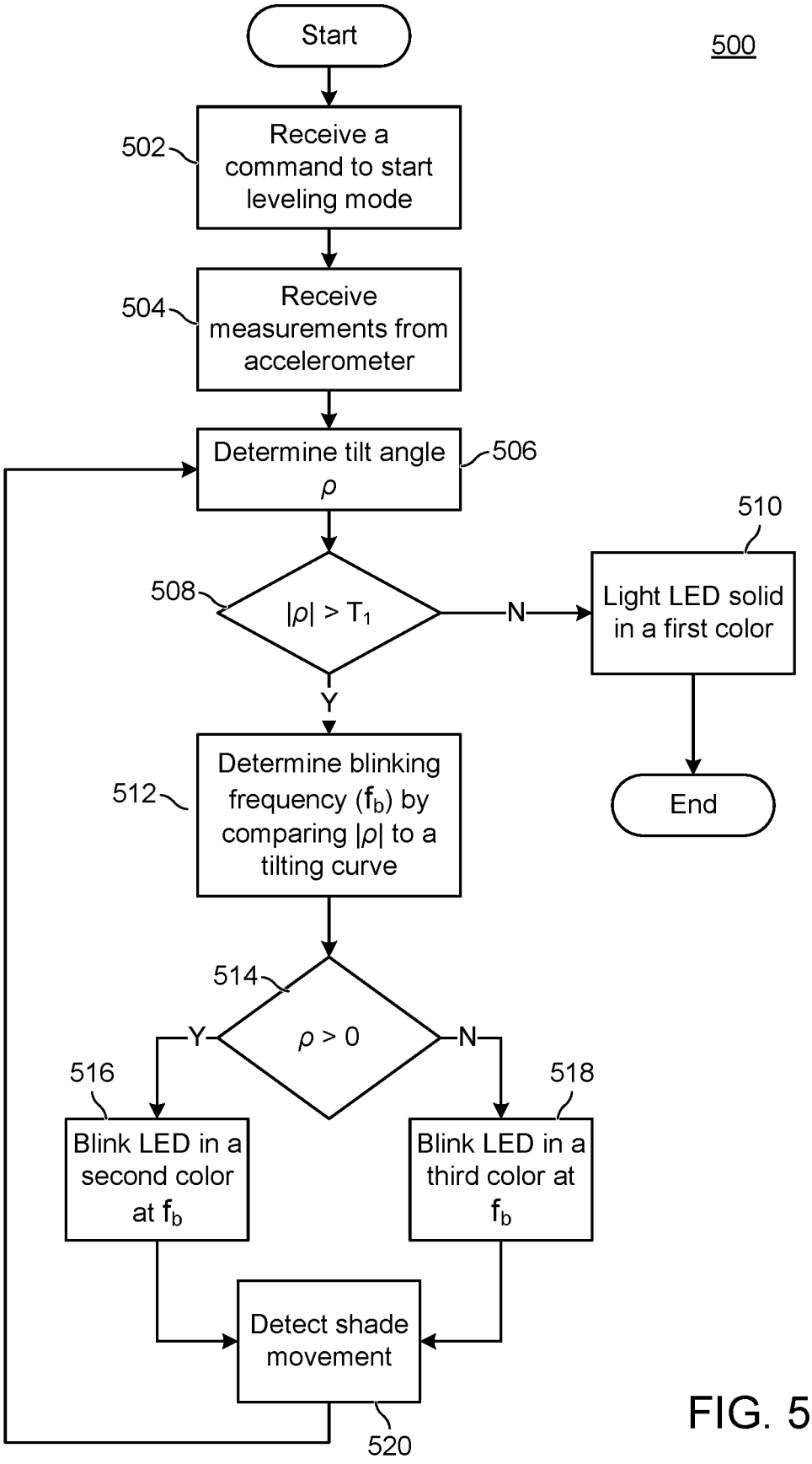

FIG. 5 shows a flowchart illustrating a method of leveling the roller shade using the "leveling mode" according to an illustrative embodiment.

Figure 6:
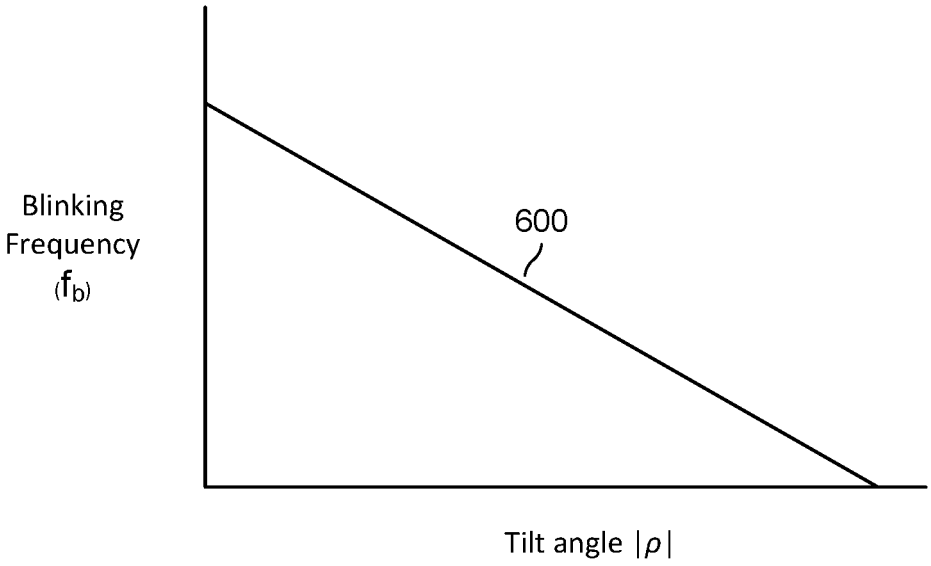

FIG. 6 illustrates a tilting curve according to an illustrative embodiment.

Figure 7:
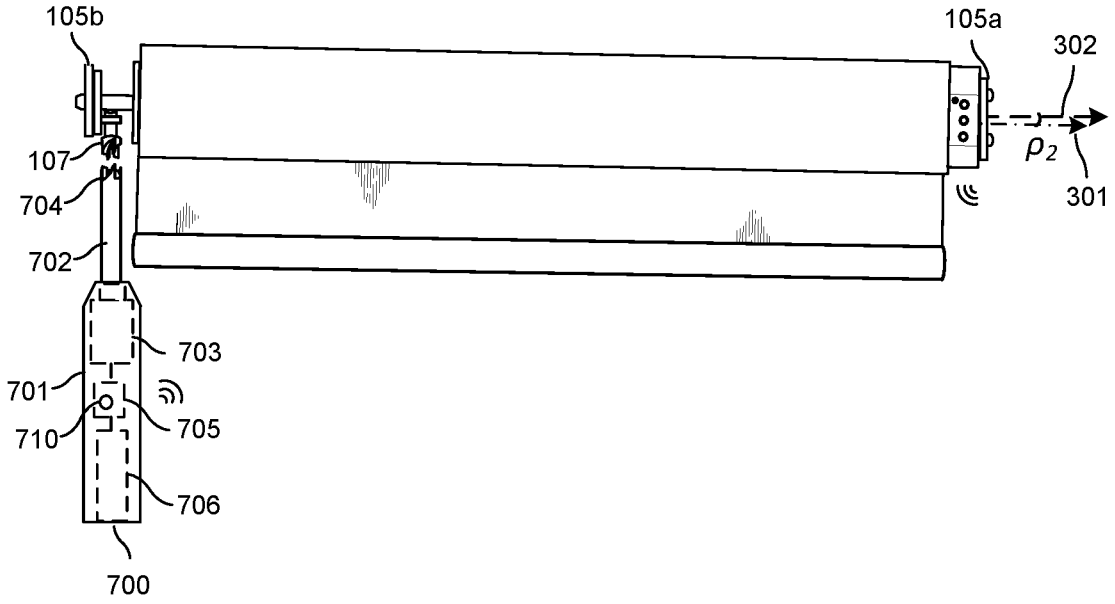

FIG. 7 illustrates a front view of a roller shade in operation with a leveling tool according to an illustrative embodiment.

Figure 8:
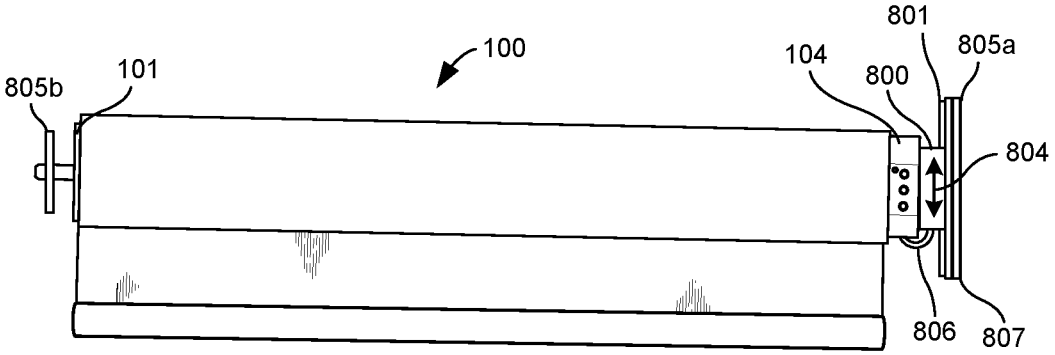

FIG. 8 illustrates a roller shade with a self-adjusting mounting bracket according to an illustrative embodiment.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" on "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Roller Shade
101 Idler Assembly
102 Roller Tube
103 Keyhole
104 Roller Shade Drive Unit
105*a* First Mounting Bracket
105*b* Second Mounting Bracket
106 Shade Material
107 Vertical Adjustment Screw
108*a* First End
108*b* Second End
109 Idler Pin
110 Hem Bar
111 Longitudinal Axis of the Roller Shade
112 Motor Control Module
113 Idler Pin Tip
114 Motor
115 Screws
116 Crown Adapter
117 Drive Wheel
118 Idler Body
119 Flange
120 Positive x, y, z Axis of the Accelerometer
122 Channels
124 Projections
125 Teeth
126 Flange
128 Power Cord
130 Circuit
131 User Interface/Buttons
132 Terminal Block
133 Light Indicator/LED
135 Roll
136 Pitch
200 Block Diagram of the Roller Shade Drive Unit
202 Power Supply
204 Controller
206 Memory
208 Accelerometer
210 Interface
212 Speaker
302 Earth's Horizontal Plane
400 Flowchart Illustrating a Method of Determining Whether the Roller Shade is Properly Leveled
402-416 Steps of Flowchart 400
500 Flowchart Illustrating a Method of Leveling the Roller Shade Using the "Leveling Mode"
502-520 Steps of Flowchart 500
600 Tilting Curve
700 Handheld Leveling Tool
701 Handle
702 Shank
703 Motor
704 Tip
705 Wireless Interface
706 Power Supply
710 Button
800 Linear Motor
801 Linear Guide Rail
804 Vertical Direction
805*a* Self-Adjusting Mounting Bracket
805*b* Fixed Mounting Bracket
806 Wire
807 Mounting Portion

LIST OF ACRONYMS USED IN THE SPECIFICATION IN ALPHABETICAL ORDER

The following is a list of the acronyms used in the specification in alphabetical order.

AC Alternating Current
ASIC Application Specific Integrated Circuit
BLDC Brushless Direct Current
CAT5 Category 5 Cable
$f_b$ Blinking Frequency
G Gravitational Force
g-force Gravitational Force
$I^2C$ Inter-Integrated Circuit
IR Infrared
LAN Local Area Network
LED Light Emitting Diode
m/s2 Meters per Second Squared
PWM Pulse-Width Modulated
ρ Tilt Angle
PoE Power over Ethernet
QMT Quiet Motor Technology
RAM Random-Access Memory
RF Radio Frequency
ROM Read-Only Memory
SPI Serial Peripheral Interface $T_1$ First Threshold Value
$T_2$ Second Threshold Value

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamline technology, improving the quality of life in commercial buildings, universities, hotels, hospitals, and homes, among other locations. Accordingly, the systems, methods, and modes of the aspects of the embodiments described herein can be manufactured by Crestron Electronics Inc., located in Rockleigh, N.J.

The different aspects of the embodiments described herein pertain to the context of a motorized window treatment, but is not limited thereto, except as may be set forth expressly in the appended claims. While the motorized window treatment is described herein for covering a window, the motorized window treatment may be used to cover doors, wall openings, or the like. Additionally, while the embodiments described herein reference a roller shade, the embodiments described herein, and particularly the systems, methods, and modes for automatically determining and reporting the tilt level of a motorized window treatment, may be adapted in other types of motorized window treatments, such as inverted rollers, Roman shades, Austrian shades, pleated shades, blinds, shutters, skylight shades, garage doors, or the like.

Referring to FIG. 1, there is shown an exploded front perspective view of a roller shade 100 according to one aspect of the embodiments. Roller shade 100 generally comprises a roller tube 102, roller shade drive unit 104, idler assembly 101, shade material 106, and a hem bar 110. Shade material 106 is connected at its top end to the roller tube 102 and at its bottom end to the hem bar 110. Shade material 106 wraps around the roller tube 102 and is unraveled from the roller tube 102 to cover a window, a door, a wall opening, or the like. In various embodiments, the shade material 106 comprises fabric, plastic, vinyl, or other materials known to those skilled in the art.

Roller tube 102 is generally cylindrical in shape and laterally extends from a first end 108*a* to a second end 108*b* along longitudinal axis 111. In various embodiments, the roller tube 102 comprises aluminum, stainless steel, plastic, fiberglass, or other materials known to those skilled in the art. The first end 108*a* of the roller tube 102 receives the roller shade drive unit 104. The second end 108*b* of the roller tube 102 receives the idler assembly 101.

The roller shade drive unit 104 may comprise a motor control module 112, a motor 114, a crown adapter 116, and a drive wheel 117. The roller shade drive unit 104 may be inserted within the roller tube 108 at the first end 108*a* such that it extends along longitudinal axis 111. In various embodiments, the various components of the roller shade drive unit 104 comprise aluminum, stainless steel, plastic, fiberglass, rubber, other materials known to those skilled in the art, or any combinations thereof. The motor 112 may comprise a brushless direct current (BLDC) electric motor. In another embodiment, the motor 122 comprises a brushed DC motor, or any other motor known in the art. The crown adapter 116 and drive wheel 117 are generally cylindrical in shape and are inserted into and operably connected to roller tube 102 at its first end 108*a*. Crown adapter 116 and drive wheel 117 comprise a plurality of channels 122 extending circumferentially about their external surfaces. Channels 122 mate with complementary projections 124 radially extending from an inner surface of roller tube 102 such that crown adapter 116, drive wheel 117, and roller tube 102 rotate together during operation. Crown adapter 116 can further comprise a plurality of teeth 125 extending circumferentially about its external surface to form a friction fit between the crown adapter 116 and the inner surface of the roller tube 102. Crown adapter 116 can further comprise a flange 126 radially extending therefrom. Flange 126 prevents the crown adapter 116 from sliding entirely into the roller tube 102. The crown adapter 116 removably and releasably couples the roller shade drive unit 104 to the roller tube 102. The roller shade drive unit 104 may comprise similar configuration to the CSM-QMTDC-250-4-EX Digital QMT® Shade Motor, available from Crestron Electronics, Inc. of Rockleigh, N.J. The Crestron® CSM-QMTDC-250-4-EX shade motor utilizes the quiet, precision-controlled Quiet Motor Technology (QMT) to control the movement of the shade, keep track of the shade's position, and adjust the shade to the user's desired preset positions.

The idler assembly 101 of the roller shade 100 may comprise an idler pin 109 and an idler body 118 inserted into the second end 108*b* of the roller tube 102. The idler body 118 may be rotatably connected about the idler pin 109. It is inserted into the roller tube 102 and is operably connected to the roller tube 102 such that rotation of the roller tube 102 also rotates the idler body 118. The idler body 118 may comprise a flange 119, similar to flange 126, to prevent the idler body 118 from sliding entirely into the roller tube 102. The idler body 118 may comprise ball bearings therein (not shown) allowing the idler body 118, and thereby the roller tube 102, rotate with respect to the idler pin 109. The idler pin 109 may include a pin tip 113 disposed on the terminal end of the idler pin 109 to attach the roller shade 100 to mounting bracket 105*b*. In one embodiment, the idler body 118 may comprise similar configuration to the idler body having a counterbalancing assembly disclosed in U.S. Pat. No. 9,631,425, issued on Apr. 25, 2017, and titled "Roller Shade with a Pretensioned Spring a Method for Pretensioning the Spring," the entire contents of which are hereby incorporated by reference.

During installation, the roller shade 100 is mounted on or in a window between the first and second mounting brackets 105*a* and 105*b*. The roller shade 100 may first be mounted to the second mounting bracket 105*b* by inserting the idler pin tip 113 into a keyhole 103 of the second mounting bracket 105*b*. Specifically, the second mounting bracket 105*b* may comprise a keyhole 103 and a level adjustment member, such as a vertical adjustment screw 107. The idler pin tip 113 may be inserted into the top of the keyhole 103 and slid down into the keyhole 103 such that it sits on the vertical adjustment screw 107. The roller shade 100 may then be mounted to the first mounting bracket 105*a* by snapping the roller shade drive unit 104 to the first mounting bracket 105*a* or coupling the roller shade drive unit 104 to the first mounting bracket 105*a* using screws 115. The mounting brackets 105*a* and 105*b* can comprise similar configuration to the CSS-DECOR3 QMT®3 Series Décor Shade Hardware, available from Crestron Electronics, Inc. of Rockleigh, N.J. The second mounting bracket 105*b*, when attached to a roller shade 100 and mounted to a ceiling or inside a window box, enables the horizontal level of the roller shade 100 to be adjusted by tightening or loosening the vertical adjustment screw 107. Although the second mounting bracket 105*b* with the vertical adjustment screw 107 is shown on the idle end of the roller shade 100, the second mounting bracket 105*b* may alternatively be used on the motor end of the roller shade 100 allowing horizontal level adjustment at the motor end of the shade. Additionally, the first mounting bracket 105*a* may contain similar configuration to the second mounting bracket 105*b*, allowing horizontal level adjustment on both idler and motor ends of the shade. Other types of level adjusting brackets may be utilized without departing from the scope of the present embodiments.

In operation, the roller shade 100 is rolled down and rolled up via the roller shade drive unit 104. Particularly, the motor 114 drives the drive wheel 117, which in turn engages and rotates the roller tube 102; and the roller tube 102 engages and rotates the crown adapter 116 and idler body 118 with respect to the motor 114, while the motor 114 and motor control module 112 remain stationary. As a result, the shade material 106 may be lowered from an opened or rolled up position, when substantially the entire shade material 106 is wrapped about the roller tube 102, to a closed or rolled down position, when the shade material 106 is substantially unraveled.

The motor control module 112 operates to control the motor 114, directing the operation of the motor, including its direction, speed, and position. The motor control module 112 comprises fully integrated electronics, including circuit 130. Power can be supplied to the motor control module 112 through a power cord 128 by connecting a terminal block 132 to a dedicated power supply (not shown), such as the CSA-PWS40 or CSA-PWS10S-HUB-ENET power supplies, available from Crestron Electronics, Inc. of Rockleigh, N.J. In another embodiment, the motor control module 112 may be battery operated. Motor control module 112 can further comprise a local user interface 131, such as a three-button interface, that allows users to test the roller shade 100 after installation and also to set the shade limits. Furthermore, the motor control module 112 may comprise a light indicator 133, such as a multicolor light emitting diode (LED), for indicating the motor status.

FIG. 2 is an illustrative block diagram 200 of the roller shade drive unit 104 according to one embodiment. The roller shade drive unit 104 may comprise the motor 114 and a motor control module 112. The motor control module 112 can comprise a controller 204, a memory 206, an interface 210, an accelerometer 208, a user interface 131, a light indicator 133, and a speaker 212. An external power supply 202 can provide power to the circuit of the motor control module 212, and in turn the motor 114. In another embodiment, the roller shade drive unit 104 may comprise an internal power supply, such as batteries.

Controller 204 can represent one or more microprocessors, and the microprocessors can be "general purpose" microprocessors, a combination of general and special purpose microprocessors, or application specific integrated circuits (ASICs). Controller 204 can provide processing capability to provide processing for one or more of the techniques and functions described herein.

Memory 206 can be communicably coupled to controller 204 and can store data and executable code. In another embodiment, memory 206 is integrated into the controller 204. Memory 206 can represent volatile memory such as random-access memory (RAM), but can also include non-volatile memory, such as read-only memory (ROM) or Flash memory.

Controller 204 may further comprise an interface 210, such as a wired or a wireless interface, configured for receiving control commands from an external control point. The wireless interface may be configured for bidirectional wireless communication with other electronic devices over a wireless network. In various embodiments, the wireless interface 210 can comprise a radio frequency (RF) transceiver, an infrared (IR) transceiver, or other communication technologies known to those skilled in the art. In one embodiment, the wireless interface 210 communicates using the infiNET EX® protocol from Crestron Electronics, Inc. of Rockleigh, N.J. infiNET EX® is an extremely reliable and affordable protocol that employs steadfast two-way RF communications throughout a residential or commercial structure without the need for physical control wiring. infiNET EX® utilizes 16 channels on an embedded 2.4 GHz mesh network topology, allowing each infiNET EX® device to function as an expander, passing command signals through to every other infiNET EX® device within range (approximately 150 feet or 46 meters indoors), ensuring that every command reaches its intended destination without disruption. In another embodiment, communication is employed using the ZigBee® protocol from ZigBee Alliance. In yet another embodiment, interface 210 may communicate via Bluetooth transmission.

The wired interface 210 may be configured for bidirectional communication with other devices over a wired network. The wired interface 210 can represent, for example, an Ethernet or a Cresnet® port. Cresnet® provides a network wiring solution for Crestron® keypads, lighting controls, thermostats, and other devices. The Cresnet® bus offers wiring and configuration, carrying bidirectional communication and 24 VDC power to each device over a simple 4-conductor cable.

In various aspects of the embodiments, the interface 210 and/or power supply 202 can comprise a Power over Ethernet (PoE) interface. The controller 204 can receive both the electric power signal and the control input from a network through the PoE interface. For example, the PoE interface may be connected through category 5 cable (CAT5) to a local area network (LAN) which contains both a power supply and multiple control points and signal generators. Additionally, through the PoE interface, the controller 204 may interface with the internet and receive control inputs remotely, such as from a homeowner running an application on a smart phone.

The control commands received by the controller 204 may be a direct user input to the controller 204 from the user interface 131 or a wired or wireless signal from an external control point. For example, the controller 204 may receive a control command from a wall-mounted button panel or a touch-panel in response to a button actuation or similar action by the user. Control commands may also originate from a signal generator such as a timer or a sensor. Accordingly, the motor control module 112 can integrate seamlessly with other control systems using the interface 210 to be operated from keypads, wireless remotes, touch screens, and wireless communication devices, such as smart phones. Additionally, the motor control module 112 can be integrated within a large scale building automation system or a small scale home automation system and be controllable by a central control processor, such as the PRO3 control processor available from Crestron Electronics, Inc., that networks, manages, and controls a building management system.

As discussed above, the motor control module 112 may comprise a user interface 131, such as buttons, and a light indicator 133, such as a multicolor LED. The motor control module 112 may further comprise a speaker 212 for emitting audio signals to indicate the motor status.

The motor control module 112 may further comprise an accelerometer 208, or another type of level sensor. The controller 204 may use the onboard accelerometer 208 to detect the tilt or inclination level of the roller shade 100 to determine whether the shade is properly leveled. The accelerometer 208 may comprise an electromechanical device comprising capacitive plates that measures acceleration forces as the capacitance between the capacitive plates changes. In another embodiment, the accelerometer may comprise piezoelectric materials that change output electrical charge during acceleration. According to an embodiment, a low power accelerometer may be used for battery applications.

An accelerometer can be used for measuring both dynamic and static measurements of acceleration. Tilt is a static measurement where gravity is the acceleration being measured. As such, in the absence of linear acceleration, as in the roller shade application, the accelerometer output is a measurement of rotation of the gravitational field vector. The accelerometer 208 may indicate the acceleration in meters per second squared (m/s2) or in gravitational forces (g-force or G). While accelerometers may indicate a large range of force, it is preferred that the accelerometer comprises a highly sensitive accelerometer capable of measuring small tilt fluctuations with g-forces between 0 and 1.

Using the accelerometer 208, the controller 204 may determine whether the roller shade 100 is tilted as well as the tilt level or tilt angle ρ with respect to local Earth horizontal plane. According to an embodiment, the accelerometer 208 may comprise a three-axis accelerometer. Referring to FIG. 1, element 120 represents an exemplary positive x, y, z axis of measurement for the triple axis accelerometer discussed herein. Although it should be understood that the accelerometer 208 can be mounted at any orientation on the circuit board 130 which can, in turn, be mounted at an arbitrary angle in the roller shade 100. Beneficially, a three axis accelerometer 208 allows the controller 104 to determine in which orientation the accelerometer 208 is installed. It also allows the motor control module 104 of the roller shade 100 to be mounted in several different orientations about its longitudinal axis 111 during field installation while still being able of determining the roller shade's tilt level. For example, referring to FIG. 1, once mounted, the angular orientation of the motor control module 104 could be with the user interface buttons 131 facing forward as shown in FIG. 1, facing the ground, facing up, or at some angle in between. Depending on the orientation, the controller 204 will need to choose the correct two axis for the tilt measurement.

Because the actual orientation of the accelerometer 208 may be slightly varied in every roller shade 100, the orientation of the accelerometer 208 of each roller shade 100 may be first calibrated at the factory to the body of the roller shade 100 by mounting an assembled roller shade 100 on a level gantry to adjust tolerance or sensitivity and eliminate offset errors. The accelerometer 208 may be calibrated with the assumption that the longitudinal axis 111 of the roller shade 100 should be substantially perpendicular to the gravitational force, or in other words substantially parallel to the ground or the earth's horizontal plane 302 as shown in FIG. 3A. Other error corrections may be performed on each accelerometer 208 to ensure accuracy and proper operation. For example, the following error correction techniques may be performed at the factory or during operation to increase the accuracy of the accelerometer 208: correction of sensor bias errors and sensitivity errors, temperature compensation techniques, voltage compensation to reduce ratiometric errors, as well as other techniques known in the art.

The accelerometer 208 may be connected to the controller 204 via an analog interface, a digital interface (e.g., Serial Peripheral Interface (SPI), Inter-Integrated Circuit ($I^2C$), or the like), or a pulse-width modulated (PWM) interface. An accelerometer with an analog interface may output varying voltage levels to indicate the g-force measurement. A digital accelerometer may output a digital signal containing a value that indicates the g-force measurement. While a PWM accelerometer may output a PWM square waves with a varying duty cycle to indicate the g-force measurement. The controller 204 may convert the output of the accelerometer 208 to determine the level of inclination or the tilt level of the roller shade 100.

According to one embodiment, the controller 204 may convert the measured acceleration or gravitational force values to the level of inclination or tilt by first calculating the pitch angle and the roll angle of the roller shade 100. Referring to FIG. 1, the roll angle 135 is the orientation angle of the motor control module 104 about the x axis in relation to gravity. As discussed above, the motor control module 104 may be installed with the buttons 131 facing forward, up, down, or at some other orientation. The roll angle may be determined using the following equation:

$$\text{Roll} = \arctan\left(\frac{A_y}{\sqrt{(A_x)^2 + (A_z)^2}}\right)$$

where, $A_x$ is the output acceleration along the x axis;

$A_y$ is the output acceleration along the y axis; and $A_z$ is the output acceleration along the z axis.

The pitch angle 136 is the orientation angle of the longitudinal axis 111 of the motor control module 104 (i.e., about they axis) in relation to gravity. The pitch angle may be determined using the following equation:

$$\text{Pitch} = \arctan\left(\frac{A_x}{\sqrt{(A_y)^2 + (A_z)^2}}\right)$$

The pitch and roll angles may then be combined into a plane of inclination to determine the inclination or tilt angle ρ using the following equation:

$$\rho = \arctan\left(\frac{\sin(\text{Roll})}{\tan(\text{Pitch})}\right)$$

The roller shade may be tilted either to the right or to the left (i.e., a first tilt direction or a second tilt direction). A positive tilt angle means that the corresponding positive axis of the accelerometer 208 is pointed above the horizon, whereas a negative angle means that the axis is pointed below the horizon. For example, FIG. 3A illustrates a properly leveled roller shade 100 where its longitudinal axis 111 is parallel with the earth's horizontal plane 302, i.e., the tilt angle ρ is zero. FIG. 3B illustrates a tilted roller shade 100 with a positive tilt angle $\rho_1$ where the longitudinal axis 111 of the roller shade 100 is above the earth's horizontal plane 302. To level the roller shade 100 of FIG. 3B, the vertical adjustment screw 107 may be tightened to raise the idler pin tip 113 until the longitudinal axis 111 of the roller shade 100 is parallel with the earth's horizontal plane 302. FIG. 3C illustrates a tilted roller shade 100 with a negative tilt angle $\rho_2$ where the longitudinal axis 111 of the roller shade 100 is below the earth's horizontal plane 302. To level the roller shade 100 of FIG. 3C, the vertical adjustment screw 107 may be loosened to lower the idler pin tip 113 until the longitudinal axis 111 of the roller shade 100 is parallel with the earth's horizontal plane 302.

It should be understood that other methods may be utilized for determining the tilt level of the roller shade 100, or of another motorized window treatment. For example, the three axis accelerometer 208 may be used to determine the tilt level of a roller shade that comprises a motor control module that rotates with the roller tube during use, causing the accelerometer 208 to also rotate. In such a case, the formula for determining the tilt angle will be different because the tilt will not be calculated in relation to a fixed axis, but instead in relation to an intermediate axis.

Upon determining that the roller shade 100 is not properly leveled, the controller 204 may provide an indicator to the user, which may indicate improper shade leveling as well as the calculated tilt angle ρ. As such, the accelerometer 208 inside the roller shade drive unit 104 acts as a leveling gauge for the roller shade 100. For example, the roller shade drive unit 104 can blink its LED or emit a sound, indicating that the shade is not leveled. Existing solutions rely on the installer to check for levelness before operating the shade using external measurement devices such as a bubble level or laser level. Not only does this require the installer to have such device in their possession, but also requires them to properly measure the levelness of the shade. By providing an indicator, there is less chance of the installer forgetting to level the shade prior to operation. As such, the present embodiments prevent any problems that occur as a result of an improperly level shade from happening in the first place.

Referring to FIG. 4, there is shown a flowchart 400 illustrating a method of determining whether the roller shade 100 is properly leveled, according to one illustrative embodiment. In step 402, the roller shade drive unit 104 is powered up. The controller 204 may determine whether the roller shade 100 is properly leveled upon each power up of the roller shade drive unit 104. For example, during the installation and setup of the roller shade 100, at some point, power is applied to the roller shade drive unit 104 and then upper and lower limits are set. At that point, the controller 204 may determine whether the roller shade 100 is properly leveled.

In step 404, the controller 204 may receive measurements from the accelerometer 208. In step 406, the controller 204 may determine the tilt angle ρ, as described above. Then, in step 408, the controller 204 may compare the determined tilt angle ρ to a first threshold value $T_1$. Because the tilt angle ρ can be positive or negative, according to an embodiment, an absolute value of the tilt angle ρ may be compared to the first threshold value $T_1$. For example, the first threshold value $T_1$ may be anywhere in the range from about 0 degrees to about 1 degrees. If the absolute value of the determined tilt angle ρ is below the first threshold value $T_1$, then the controller 204 may determine that the roller shade 100 is properly leveled and resume normal operation in step 414. As such, the tilt angle ρ can be $T_1$ units above or below the perfect level (0) without the controller 204 issuing any errors. A tilt angle ρ that is $T_1$ units above or below 0 adds some padding allowing the roller shade 100 to be slightly out of level without alerting the user because it will be nearly impossible to make it perfect. If, on the other hand, the controller 204 determines that the absolute value of the determined tilt angle ρ exceeds the first threshold value $T_1$, then the controller 204 moves to step 410.

In step 410, the controller 204 may compare the absolute value of the determined tilt angle ρ to a second threshold value $T_2$. According to an embodiment, the second threshold value $T_2$ is larger than the first threshold value $T_1$. For example, the second threshold value $T_2$ may be in the range from about 1 degree to about 2 degrees. If the absolute value of the determined tilt angle ρ is below the second threshold value $T_2$, then the controller 204 may determine that the roller shade 100 is improperly leveled, but operation of the roller shade 100 is less likely to operate improperly and damage the shade. Thus, the controller may issue a first error signal in step 412, but resume normal operation in step 414. For example, the first error signal may comprise an indicator to the user that the roller shade is improperly leveled. As such, the tilt angle ρ can be $T_2$ units above or below the perfect level (0), causing the motor to give warning or error, but still operate. However, if the controller 204 determines that the absolute value of the determined tilt angle ρ is above the second threshold value $T_2$, then the controller 204 may determine that the roller shade 100 is improperly leveled and is more likely to operate improperly. Therefore, the controller 204 may issue a second error signal in step 416. The second error signal may stop or disable the motor 114 from moving to prevent damage to the shade. The second error signal may also provide an indicator to the user that the roller shade is improperly leveled. The controller 204 may later enable the motor 114 after determining that the roller shade 100 is properly leveled. Although method in FIG. 2 is illustrated with two threshold values, a single threshold value or additional threshold values may be used.

According to an embodiment, after the initial setup, the roller shade drive unit 104 may continue monitoring the tilt level. If at any time something changes and the roller shade 100 is no longer level, any of the above actions can be taken to indicate that there could potentially be a problem. For example, in step 418, the controller 204 may receive a command to move the roller shade 100. As such, each time before moving the roller shade 100, the controller 204 may first determine whether the roller shade is properly leveled by going through steps 404 through 416 as discussed above. If the roller shade 100 is leveled, the controller 204 would resume normal operation and respond to the command to move the shade. Otherwise, upon determining improper level, the controller 204 may issue an error signal and disable the motor.

The controller 204 may emit various types of error signals upon detecting that the roller shade 100 is improperly leveled. According to one embodiment, the controller 204 may emit a visual indicator, such as blinking the LED 133 on the roller shade drive unit 104, indicating to the installer that the shade 100 is not leveled. As discussed above, the controller 204 may prevent the roller shade 100 from moving when it's not level to prevent any damage to the shade fabric. According to another embodiment, the controller 204 may send an error message through the interface 210. Such an error message may comprise, for example, an e-mail, a text message, a smart message, or any other type of message known in the art. According to another embodiment, the controller 204 may transmit an error message directly to the phone of the user in proximity of the roller shade 100 using Bluetooth. The message may be sent to the installer or the user letting them know the roller shade is not leveled. The error message may also contain the amount by which the roller shade 100 is not leveled, it may contain the determined tilt angle ρ, as well as instructions on how to properly level the roller shade 100. For example, the error message may provide guidance to the user that either the left or right side of the shade has to be moved up or be moved down. Additionally, the controller 204 may store level information, including the determined tilt angle ρ, in memory 206 indicating that the roller shade 100 is not leveled. Firmware may report back the level information through analog/digital joins allowing technicians to troubleshoot improper operation of the roller shade 100.

According to yet another embodiment, the roller shade drive unit 104 may emit sound indicating to the installer or the user that the roller shade 100 is not leveled. The controller 204 may send a signal to a speaker 212 to emit the error signal. In another embodiment, noise can be emitted using the BLDC motor 114 where the roller shade drive unit 104 does not contain a speaker 212. The controller 204 may send tone to the motor itself, which in response will vibrate to make audible sound. Specifically, the controller 204 may generate an alternating current (AC) signal to the motor 114 comprising a sinusoid wave indicating the tone. In response, the BLDC motor 114 can operate similar to a speaker. The BLDC motor 114 contains windings that basically operate the same as voice coils in a speaker, while the rotor of the motor operates as the magnet of the speaker. The current in the rotor generates a magnetic field which applies a force on the permanent magnet of the motor causing rotation of the shaft. The AC signal causes the motor 114 to vibrate back and forth quickly enough that it does not affect or move the shade materials. This produces vibrations at a frequency that the user can perceive as sound. As such, the roller shade drive unit 104 may generate any audio signal as an error signal using the BLDC motor 114 without the use of a speaker.

The controller 204 of the roller shade drive unit 104 may further support a "leveling mode" where blinking LEDs and/or audible sound may aid the installer in adjusting hardware, such as the mounting brackets 105*a* and 105*b*, to ensure the roller shade 100 is properly leveled. For example, a blinking LED may blink slowly when the tilt angle ρ is largely off level and as shade gets closer to being level, LED blinks quicker, then solid when its level. Two different colors may be used to indicate in which direction the roller shade 100 is tilted, and therefore, whether the installer needs to raise or lower one end of the roller shade 100, for example using the second mounting bracket 105*b*. A third color may be used to indicate that the shade is properly leveled. Alternatively, the roller shade drive unit 104 may generate a slow beeping sound when the tilt angle ρ is largely off level and as shade gets closer to level, the beep gets faster, then a solid tone when its level. Often, when installing the roller shade 100, the installer may be on the opposite side of the roller shade drive unit 104 and would not see the flashing LED light 133. With the noise, the roller shade drive unit 104 may use two different tones indicating in which direction the roller shade 100 is tilted, and beep them up faster when the roller shade 100 gets to the desired level. A third tone may be used to indicate that the roller shade 100 is properly leveled. In another embodiment, both blinking LED and a beeping sound may be used.

Referring to FIG. 5, there is shown a flowchart 500 illustrating a method of leveling the roller shade 100 using the "leveling mode", according to one illustrative embodiment. In step 502, the controller 204 may receive a command to start the leveling mode. For example, the user may depress one or more buttons on the user interface 131 to initiate the leveling mode. In response, the controller 204 receives measurements from the accelerometer 208 in step 504. In step 506, the controller 204 determines the tilt angle ρ. In step 508, the controller 204 compares the absolute value of the tilt angle ρ to the first threshold value $T_1$. If the determined tilt angle ρ is below the first threshold value $T_1$, then the controller 204 may determine that the roller shade 100 is properly leveled and light the LED 133 solid in a first color, such as color green, in step 510. If, on the other hand the controller 204 determines that the determined tilt angle ρ is above the first threshold value $T_1$, then the controller 204 moves to step 512.

The controller 204 may then determine the blinking parameter of the LED such that the blinking parameter is changed as the tilt level gets closer or farther from the first threshold value $T_1$. This will inform the installer in which direction to adjust the shade. The controller 204 may blink the LED 133 by varying the frequency, the duty cycle, or combination of the frequency and the duty cycle of the input signal to the LED. For example, referring to FIG. 5, the controller 204 may determine the frequency at which to blink the LED (i.e., the blinking frequency $f_b$) in step 512. According to an embodiment, the controller 204 may compare the absolute value of the tilt angle ρ to a tilting curve 600 shown in FIG. 6 to determine the desired blinking frequency $f_b$ of the LED 133. The tilting curve 600 may comprise an inverse linear curve, although other types of curves may be used without departing from the scope of the present embodiments. The inverse linear tilting curve 600 may represent the relationship between the tilt angle ρ and a blinking frequency (or another blinking parameter) where the blinking frequency increases as the tilt level decreases. As such, the larger the tilt angle ρ of the roller shade 100 the smaller the blinking frequency $f_b$, thereby causing the LED 133 to blink slowly. The smaller the tilt angle ρ of the roller shade 100 the larger the blinking frequency $f_b$, thereby causing the LED 133 to blink fast. However, the desired blinking parameter, such as the blinking frequency $f_b$, may be determined using other methods, for example by using a lookup table.

In step 514, the controller 204 determines whether the tilt angle ρ of the roller shade 100 is larger than zero. If the tilt angle ρ is larger than zero, then the controller 204 determines that the positive axis of the accelerometer 208 is pointed above the horizon as shown in FIG. 3B. In step 516, the controller 204 may blink the LED 133 in a second color, such as color red, at the determined blinking frequency $f_b$. A red blinking LED 133 may indicate to the user to tighten the vertical adjustment screw 107 in order to level the roller shade 100. On the other hand, if the tilt angle ρ is smaller than zero, then the controller 204 determines that the positive axis of the accelerometer is pointed below the horizon as shown in FIG. 3C. In step 518, the controller 204 may blink the LED 133 at a third color, such as color blue, at the determined blinking frequency $f_b$. A blue blinking LED 133 may indicate to the user to loosen the vertical adjustment screw 107 in order to level the roller shade 100.

In step 520, the controller 204 may detect movement of the roller shade 100 as a result of the user tightening or loosening the screw 107. The method will then return to step 506 to determine a tilt angle ρ as a result of the adjustment of the roller shade 100.

For example, if the roller shade 100 is tilted with the positive axis of the accelerometer 208 pointing above the horizon 302 by a large value as shown in FIG. 3B, the LED 133 may begin slowly blinking red. If the user incorrectly loosens the screw 107, causing the roller shade 100 to get further from the proper level, the controller 204 will cause the LED 133 to blink slower in the color red indicating to the user that the vertical adjustment screw 107 is being turned in the wrong direction. As the user then tightens the screw 107, causing the roller shade 100 to get closer to the proper level, the controller 204 will cause the LED 133 to blink faster in the color red until the tilt angle ρ is below the first threshold value $T_1$, at which time the LED 133 will turn to a solid green.

Similarly, if the roller shade 100 is tilted with the positive axis of the accelerometer 208 pointing below the horizon 302 by a large value as shown in FIG. 3C, the LED 133 may begin slowly blinking blue. If the user incorrectly tightens the screw 107, causing the roller shade 100 to get further from the proper level, the controller 204 will cause the LED to blink slower in the color blue indicating to the user that the vertical adjustment screw 107 is being turned in the wrong direction. As the user then loosens the screw 107, causing the roller shade 100 to get closer to the proper level, the controller 204 will cause the LED to blink faster in the color blue until the tilt angle ρ is below the first threshold value $T_1$, at which time the LED 133 will turn to a solid green. After the shade 100 is properly leveled, the controller 204 will end the "leveling mode".

Although red, blue, and green colors are utilized in the method shown in FIG. 5, any other indicator colors may be used as well. Additionally, instead of using the light indicator, such as LED 133, the method of FIG. 5 may be applied to emit audible beeping sounds using an audible indicator, such as a speaker 212 or the motor 114, as discussed above. The controller 204 may change various sound parameters of the audible indicator as the tilt level gets closer or farther from the first threshold value. For example, the controller 204 may increase the frequency of the beep interval as the level of the roller shade 100 gets closer to the proper level, decrease the frequency of the beep interval as the level of the roller shade 100 gets farther from the proper level, and emit a solid tone when the level of the roller shade 100 is at the proper level. The controller 204 may further cause the audible indicator to emit different tones depending on the tilt direction of the roller shade 100. For example, the controller 204 may cause the audible indicator to emit a first tone when the tilt level is below the first threshold value, emit a second tone when the tilt level is above the first threshold value in a first tilting direction, and emit a third tone when the tilt level is above the first threshold value in a second tilting direction. In another embodiment, the motor control module 104 may utilize both a blinking light indicator and a beeping sound according to FIG. 5.

According to an embodiment, the level determining feature shown in FIGS. 4 and 5 may be turned off by the user, for example by pressing buttons at the user interface 131.

In another embodiment, a handheld leveling tool 700 may be provided as shown in FIG. 7. The leveling tool 700 may comprise a handle 701 and a shank 702 comprising a tip 704 that mates with the head of the vertical adjustment screw 107. The tip 704 may comprise a unique keyed tip for use only with a unique keyed head of the vertical adjustment screw 107, as shown in FIG. 7. Alternatively, the tip 704 may comprise a flat tip, a Philips tip, or another conventionally utilized tip. Leveling tool 700 may further comprise a motor 703 capable of rotating the shank 702 in either direction. A power supply 706, such as a battery, is provided for powering the motor 703 as well as other electronic components of the leveling tool 700. Additionally, the leveling tool 700 comprises a wireless interface 705 similar to, and capable of communicating with, the wireless interface 210 of the roller shade drive unit 104.

In operation, after determined the tilt angle ρ, the controller 204 of the roller shade drive unit 104 may determine the direction of rotation and calculate the number of revolutions necessary to turn the screw 107 to bring the roller shade 100 to a properly leveled position. Memory 206 may store necessary information indicating the relation between the direction and revolutions and the tilt angle. The controller 204 may then transmit a message via the wireless interface 210 containing the determined direction and the number of revolutions to the handheld leveling tool 700. In response, the leveling tool 701 will receive the message and turn the vertical adjustment screw 107 per the instructions of the controller 204. The leveling tool 700 may further comprise a sensor for detecting contact with the vertical adjustment screw 107. As such, the leveling tool 700 may start applying rotational force only upon contact with the vertical adjustment screw 107. The leveling tool 700 may also comprise a button 710 to enable pairing of the leveling tool 700 with the roller shade drive unit 104, for example through an ultrasonic pairing technique.

FIG. 8 illustrates a roller shade with a self-adjusting mounting bracket 805*a* according to an illustrative embodiment. The idler side 101 of the roller shade 100 may be attached to a fixed mounting bracket 805*b*. The drive unit side 104 of the roller shade 100 may be attached to the self-adjusting bracket 805*a*. The self-adjusting bracket 805*a* may comprise a mounting portion 807 comprising holes for attaching the self-adjusting bracket 805*a* to a surface of a window via mounting screws (not shown). The self-adjusting bracket 805*a* may further comprise a linear motor 800 that vertically travels along a linear guide rail 801. The linear guide rail 801 may be fixedly attached to the mounting portion 807, while the linear motor 800 may be directly attached to the drive unit 104. As such, as the linear motor 800 travels along the linear guide rail 801 in vertical direction 804, the roller shade drive unit 104 moves vertically with respect to the mounting portion 807 of the self-adjusting mounting bracket 805*a*. The linear motor 800 of the self-adjusting bracket may be directly wired to the drive unit 104 with wire 806 to receive power as well as operational instructions from the drive unit 104.

In operation, after determined the tilt angle ρ, the controller 204 of the roller shade drive unit 104 may direct the linear motor 800 of the self-adjusting bracket 805*a* to translate up or down until the roller shade 100 is properly leveled. Using the accelerometer 208, the controller 204 may continuously monitor the level of the roller shade 100 as it is translated up or down by the linear motor 800 along linear guide rail 801.

According to another embodiment, the self-adjusting bracket 805*a* may be attached to the idler side 101 of the roller shade 100 and be separately wired to a power supply. In such configuration, the self-adjusting bracket 805*a* may comprise a wireless interface similar to, and capable of communicating with, the wireless interface 210 of the roller shade drive unit 104.

INDUSTRIAL APPLICABILITY

To solve the aforementioned problems, the aspects of the embodiments are directed towards systems, method, and modes for automatically determining and reporting the level of a motorized window treatment. However, it should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments.

What is claimed is:

1. A motorized window treatment assembly adapted to adjustably cover a window comprising:

a pair of stationary mounting brackets adapted to attach to opposite sides of the window;

a roller tube extending along a longitudinal axis and attached to and between the pair of stationary mounting brackets such that the roller tube is stationary with respect to earth's horizontal plane but is capable of rotating about the longitudinal axis;

a window covering material comprising a first end attached to the roller tube and a second end attached to a hem bar;

a drive unit at least partially residing within the roller tube, wherein the drive unit comprises:

a motor that rotates the roller tube to raise or lower the window covering material between an opened position and a closed position;

an accelerometer configured for measuring gravitational forces; and a controller for controlling the motor, wherein the controller:

receives gravitational force measurements from the accelerometer;

determines a tilt level of the drive unit with respect to the earth's horizontal plane using the gravitational force measurements;

compares the tilt level to a first threshold value; and issues an error signal when the tilt level exceeds the first threshold value;

wherein at least one of the pair of mounting brackets is adjustable such that tilt of the drive unit can be adjusted until a determined tilt level is below the first threshold value.

2. The motorized window treatment assembly of claim 1, wherein the accelerometer comprises a three-axis accelerometer.

3. The motorized window treatment assembly of claim 1, wherein the tilt level comprises a tilt angle of the drive unit.

4. The motorized window treatment assembly of claim 1, wherein the error signal comprises a light indicator.

5. The motorized window treatment assembly of claim 1, wherein the error signal comprises an audible indicator.

6. The motorized window treatment assembly of claim 5 further comprising a speaker that emits the audible indicator.

7. The motorized window treatment assembly of claim 5, wherein the motor emits the audible indicator.

8. The motorized window treatment assembly of claim 1, wherein the drive unit further comprises an interface, wherein the error signal comprises an error message, and wherein the controller transmits the error message through the interface.

9. The motorized window treatment assembly of claim 8, wherein the error message comprises at least one of an electronic mail, a text message, and a message configured to be transmitted to a phone.

10. The motorized window treatment assembly of claim 8, wherein the error message comprises at least one of a tilt angle and instructions on how to properly level the drive unit.

11. The motorized window treatment assembly of claim 1, wherein the error signal further comprises storing the tilt level in a memory of the drive unit.

12. The motorized window treatment assembly of claim 1, wherein the error signal comprises disabling the motor.

13. The motorized window treatment assembly of claim 1, wherein the controller further:

compares the tilt level to a second threshold value; and issues a second error signal upon determining that the tilt level exceeds the second threshold value.

14. The motorized window treatment assembly of claim 1, wherein the error signal comprises blinking a light indicator, wherein the controller changes a blinking parameter of the light indicator as the tilt level gets closer or farther from the first threshold value.

15. The motorized window treatment assembly of claim 14, wherein the blinking parameter comprises at least one of a frequency, a duty cycle, or a combination thereof.

16. The motorized window treatment assembly of claim 14, wherein the controller further:

causes the light indicator to blink faster when the tilt level gets closer to the first threshold value;

causes the light indicator to blink slower when the tilt level gets farther from the first threshold value; and causes the light indicator to light solid when the tilt level is below the first threshold value.

17. The motorized window treatment assembly of claim 14, wherein the controller further:

stores a relationship between a tilt level and a blinking parameter;

determines a blinking parameter of the light indicator by comparing the determined tilt level to the stored relationship; and causes the light indicator to blink at the determined blinking parameter.

18. The motorized window treatment assembly of claim 17, wherein the stored relationship comprises at least one of a tilting curve and a lookup table.

19. The motorized window treatment assembly of claim 14, wherein the controller further:

determines a tilt direction of the drive unit with respect to the earth's horizontal plane;

causes the light indicator to light solid in a first color when the tilt level is below the first threshold value;

causes the light indicator to blink in a second color when the tilt level is above the first threshold value in a first tilting direction; and causes the light indicator to blink in a third color when the tilt level is above the first threshold value in a second tilting direction.

20. The motorized window treatment assembly of claim 1, wherein the error signal comprises beeping an audible indicator, wherein the controller further:

causes the audible indicator to beep faster when the tilt level gets closer to the first threshold value;

causes the audible indicator to beep slower when the tilt level gets farther from the first threshold value; and causes the audible indicator to emit a solid tone when the tilt level is below the first threshold value.

21. The motorized window treatment assembly of claim 20, wherein the controller further:

determines a tilt direction of the drive unit;

causes the audible indicator to emit a first tone when the tilt level is below the first threshold value;

causes the audible indicator to emit a second tone when the tilt level is above the first threshold value in a first tilting direction; and causes the audible indicator to emit a third tone when the tilt level is above the first threshold value in a second tilting direction.

22. The motorized window treatment assembly of claim 1:

wherein the at least one of the mounting brackets comprises a vertical adjustment screw configured for adjusting the tilt of the drive unit;

wherein the motorized window treatment assembly further comprises a handheld leveling tool comprising an interface that receives the error signal from the controller, a shank with a tip that mates with the vertical adjustment screw, and a second motor that rotates the shank;

wherein the controller causes the second motor of the handheld leveling tool to rotate the vertical adjustment screw in a first direction until the tilt level of the drive unit is below the first threshold value.

23. The motorized window treatment assembly of claim 1:

wherein the at least one of the mounting brackets comprises a self-adjusting mounting bracket that comprises a second motor that adjusts the tilt of the drive unit and an interface that receives the error signal;

wherein the controller causes the second motor of the self-adjusting mounting bracket to operate in a first direction until the tilt level of the drive unit is below the first threshold value.

24. The motorized window treatment assembly of claim 1, wherein the at least one of the pair of mounting brackets is adapted to be manually adjustable to adjust the tilt of the drive unit.

25. A motorized window treatment assembly adapted to adjustably cover a window comprising:

a pair of stationary mounting brackets adapted to attach to opposite sides of the window;

a roller tube extending along a longitudinal axis and attached to and between the pair of stationary mounting brackets such that the roller tube is stationary with respect to earth's horizontal plane but is capable of rotating about the longitudinal axis;

a window covering material comprising a first end attached to the roller tube and a second end attached to a hem bar;

a drive unit at least partially residing within the roller tube, wherein the drive unit comprises:

a motor that rotates the roller tube to raise or lower the window covering material between an opened position and a closed position;

an accelerometer configured for measuring gravitational forces;

a light indicator; and a controller for controlling the motor, wherein the controller:

receives gravitational force measurements from the accelerometer;

determines a tilt level of the drive unit with respect to the earth's horizontal plane using the gravitational force measurements;

compares the tilt level to a first threshold value;

blinks the light indicator when the tilt level exceeds the first threshold value;

causes the light indicator to blink faster when the tilt level gets closer to the first threshold value;

causes the light indicator to blink slower when the tilt level gets farther from the first threshold value; and causes the light indicator to light solid when the tilt level is below the first threshold value;

wherein at least one of the pair of mounting brackets is adjustable such that tilt of the drive unit can be adjusted until a determined tilt level is below the first threshold value.

26. A motorized window treatment assembly adapted to adjustably cover a window comprising:

a pair of stationary mounting brackets adapted to attach to opposite sides of the window;

a roller tube extending along a longitudinal axis and attached to and between the pair of stationary mounting brackets such that the roller tube is stationary with respect to earth's horizontal plane but is capable of rotating about the longitudinal axis;

a window covering material comprising a first end attached to the roller tube and a second end attached to a hem bar;

a drive unit at least partially residing within the roller tube, wherein the drive unit comprises:

a motor that rotates the roller tube to raise or lower the window covering material between an opened position and atoll a closed position;

an accelerometer configured for measuring gravitational forces;

a light indicator; and a controller for controlling the motor, wherein the controller:

receives gravitational force measurements from the accelerometer;

determines a tilt level and a tilt direction of the drive unit with respect to the earth's horizontal plane using the gravitational force measurements;

compares the tilt level to a first threshold value;

stores a relationship between the tilt level and a blinking parameter;

determines a blinking parameter of a light indicator by comparing the determined tilt level to the stored relationship;

causes the light indicator to light solid in a first color when the tilt level is below the first threshold value;

causes the light indicator to blink in a second color at the determined blinking parameter when the tilt level exceeds the first threshold value in a first direction; and causes the light indicator to blink in a third color at the determined blinking parameter when the tilt level exceeds the first threshold value in a second direction;

wherein at least one of the pair of mounting brackets is adjustable such that tilt of the drive unit can be adjusted until a determined tilt level is below the first threshold value.

27. A motorized roller shade adapted to adjustably cover a window comprising:

a pair of stationary mounting brackets adapted to attach to opposite sides of the window;

a roller tube extending along a longitudinal axis and attached to and between the pair of stationary mounting brackets such that the roller tube is stationary with respect to earth's horizontal plane but is capable of rotating about the longitudinal axis;

a shade material comprising a first end and a second end, wherein the first end of the shade material is attached to the roller tube and wherein the second end of the shade material is attached to a hem bar;

a drive unit at least partially residing within the roller tube, wherein the drive unit comprises:

a motor that rotates the roller tube to move the shade material between an opened position and a closed position;

an accelerometer configured for measuring gravitational forces; and a controller for controlling the motor, wherein the controller:

receives gravitational force measurements from the accelerometer;

determines a tilt level of the drive unit with respect to the earth's horizontal plane using the gravitational force measurements;

compares the tilt level to a first threshold value; and issues an error signal when the tilt level exceeds the first threshold value;

wherein at least one of the pair of mounting brackets comprises an adjustment screw that is adjustable such that tilt of the drive unit can be adjusted until a determined tilt level is below the first threshold value.

* * * * *